United States Patent [19]

Khachaturian et al.

[11] Patent Number: 4,538,849

[45] Date of Patent: Sep. 3, 1985

[54] SPREADER BAR ASSEMBLY

[75] Inventors: Jon E. Khachaturian; Joseph P. Charles, both of Harvey, La.

[73] Assignee: Versabar, Inc., Harvey, La.

[21] Appl. No.: 521,365

[22] Filed: Aug. 8, 1983

Related U.S. Application Data

[63] Continuation-in-part of Ser. No. 300,059, Sep. 8, 1981, Pat. No. 4,397,493.

[51] Int. Cl.[3] ..... B66C 1/12

[52] U.S. Cl. ..... 294/81.1; 294/81.5

[58] Field of Search ..... 294/67 R, 67 D, 67 DA, 294/67 DB, 67 E, 67 EA, 74, 78 R, 78 A, 81 R, 81 SF, 82 AH, 86 LS

[56] References Cited

U.S. PATENT DOCUMENTS

| | | | |
|---|---|---|---|
| 1,802,886 | 4/1931 | Ellison | 294/82 AH |
| 2,020,174 | 11/1935 | Derossi | 294/67 E |
| 2,730,398 | 1/1956 | Huested | 294/81 R |
| 3,021,166 | 2/1962 | Kempel et al. | 294/74 |
| 3,519,302 | 7/1970 | Orenstein | 294/74 |
| 4,215,891 | 8/1980 | Thiele | 294/81 R X |
| 4,397,493 | 8/1983 | Khachaturian et al. | 294/81 R |

FOREIGN PATENT DOCUMENTS

| | | | |
|---|---|---|---|
| 153367 | 9/1953 | Australia | 294/78 R |
| 2301571 | 8/1973 | Fed. Rep. of Germany | 294/74 |
| 1101157 | 1/1968 | United Kingdom | 294/74 |
| 796168 | 1/1981 | U.S.S.R. | 294/81 R |

*Primary Examiner*—Johnny D. Cherry

*Attorney, Agent, or Firm*—Charles C. Garvey, Jr.

[57] ABSTRACT

A composite spreader frame assembly provides a primary load line having a bridle attached to the load line and four radially and branching lines connected at one respective end to the bridle. A pair of separate elongated support bars are each supported independently by the alternate radially branching lines. A plurality of lifting eyes are removably connected at each respective end of the elongated support bars. Four secondary depending load lines which are generally vertical during lifting are attached at the upper end to the lifting eyes and at the lower end to a load to be lifted.

8 Claims, 11 Drawing Figures

SPREADER BAR ASSEMBLY

REFERENCE TO RELATED APPLICATION

This application is a continuation-in-part of U.S. Ser. No. 300,059 filed Sept. 8, 1981, entitled "Spreader Bar Assembly" which issued as U.S. Pat. No. 4,397,493 on Aug. 9, 1983.

TECHNICAL FIELD

The present invention relates to spreader bars and like lifting devices. More particularly, the present invention relates to improvements in adjustable spreader bar assemblies having end portions which can be removably fitted to the ends of a section of pipe, for example, or a like structural member which has been precut to a desired length.

Even more particularly, the present invention relates to spreader bar assemblies useful in the lifting of heavy bulk packages such as prefabricated marine and oil rig buildings.

BACKGROUND ART

In the lifting of heavy, bulky equipment a crane normally provides a single load line which branches at a bridle and attaches in two portions to an elongated bar known in the art as a spreader bar. The spreader bar has one or more depending load lines which lower from its ends and affix to a piece of equipment to be lifted. This apparatus per se and the use of spreader bars is generally known in the art.

Spreader bars are normally constructed to fit a piece of equipment of a given load and dimension, and thus cannot be reused except on a piece of equipment of similar dimension and equal or lesser load. Attempts have been made in various U.S. patents to teach a method for providing an adjustable spreader bar which could be used over a variety of spreader lengths.

In U.S. Pat. No. 4,128,267 entitled "Lifting Beam" there can be seen a lifting beam comprising an elongated member carrying one or more pivotally mounted hooks for engagement of a load to be lifted. A balance weight is provided on the hooks to lie on either side of the pivotal axis thereof so as to cause the hood to be biased into or from engagement of the load to be picked up or released when the beam is lowered on to same.

In U.S. Pat. No. 4,136,903 there an be seen a "Tire Lifting Apparatus" which comprises a master support sleeve, two movable arms slideably associated therewith, and two hook units pivotably connected to the arms for easy engagement with the inner rim of a tire.

A "Handling Beam for Heavy Elongate Objects" can be seen in U.S. Pat. No. 3,762,756 which comprises a simple and reliable missile handling beam assembly readily engageable with conventional missile supporting lug arrangements. The assembly does not impose any stress on the object being handled, since a lifting hook can be located in a position closest to the center of gravity of the load, hence the attitude of the object can be easily controlled during the lifting and lowering movements.

In U.S. Pat. No. 4,258,949 entitled "Extensible Spreader Frame for Cargo Containers" there can be seen an extensible lifting spreader frame comprising a pair of oppositely extending beam arms slideably received within a central pair of side-by-side connected sleeve beams. Beam cross arms at the outer ends of the sleeve beams mount twist-lock latching hooks at their opposite ends for attachment to the four socketed top corners of a cargo container to be lifted.

A "Sling Mounting Head" for use with a spacer element and mounting two members of a sling chain can be seen in U.S. Pat. No. 4,215,891. The sling mounting head has a body portion including a central section, and first and second end sections extending from the central section.

In U.S. Pat. No. 3,206,243 issued to B. F. Miles on Sept. 14, 1965, there is seen a "Spreader Bar" apparatus.

U.S. Pat. No. 3,010,751 entitled "Adjustable Lift Hooks" issued on Nov. 28, 1961 to E. J. Day, et al.

A "Sling Carrier" device is seen in U.S. Pat. No. 3,252,729 which issued on May 24, 1966, to R. A. Holmes.

Many of these devices are highly complex in nature and because of their construction would necessarily be limited to relatively small loads.

Thus, there is a need for a simple, easy to use, easy to construct spreader bar which could easily be adapted to a variety of load and dimensional situations.

DISCLOSURE OF INVENTION

The present invention solves these prior art problems and shortcomings in a simple manner by providing a spreader bar assembly which utilizes an elongated central support bar such as, for example, an elongated section of pipe which can be precut to a desired length. A pair of end cap assemblies are connected during the lifting operation to each respective end portion of the bar to form removable connection with the bar. Each end cap attaches to a supporting bridle line. Each end cap comprises in part a socket of uniform cross-section receptive of one end of the bar therein and having a corresponding internal cross-section equal to or slightly larger than the external cross-section of the support bar. A transversely mounted stop is provided for limiting the degree of penetration of the support bar into the respective socket. In the preferred embodiment, the central support bar is an elongated section of cylindrical pipe and the sockets are cylindrical, being of an equal or slightly larger internal diameter to the external diameter of the section of pipe.

The sockets are preferably open ended at one end portion and terminate at the inner stop. One or more longitudinally, disposed lifting plates are affixed to the socket and extend away from the open end portion of the socket. Preferably a pair of openings are provided in the plant which is receptive of the bridle and lifting lines. The pair of openings are spaced apart and include one opening for the bridle line and one for the downwardly depending load line which attaches to the package being lifted. The lift opening for the bridle lift line can be located concentrically with the elongated support bar, eliminating or minimizing bending moment in the bar, regardless of the length of bridle used. Gusseting can be provided on the longitudinal lifting plates for stiffening. In the preferred embodiment gusseting is affixed by welding, for example, to the end of the socket and tangent to the socket with the gusset plates crossing.

The openings can be reinforced by thickening at their periphery for added strength. In the preferred embodiment, each longitudinal lifting plate has a pair of associated links affixed respectively to opposite sides of the longitudinal lifting plate.

From the above, one skilled in the art will see that the end lifting eye assemblies are freely removable from the pipe and thus could be reused over and over again by the attachment to lengths of pipe of desired precut dimensions. It can be seen also that the present invention allows for the use of a wide variety of sling lengths during lift due to the positioning of the bridle line openings. This would provide a spreader bar of high structural integrity, capable of lifting very heavy loads on the order of, for example, several hundred tons yet lend itself to the variety of dimensional situations.

BRIEF DESCRIPTION OF DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
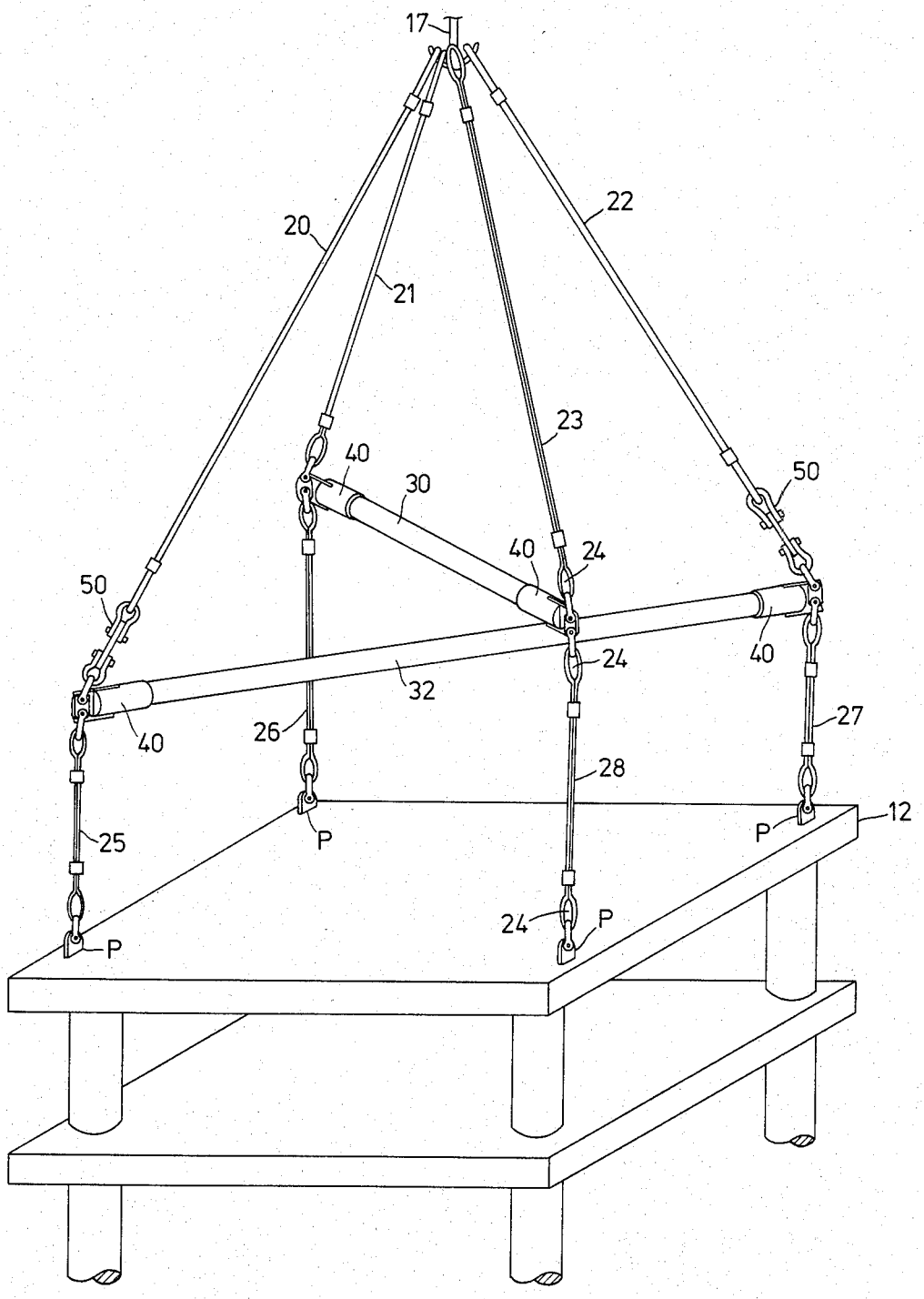
FIG. 1 is a perspective view of the composite lifting apparatus of the present invention.
Figure 2:
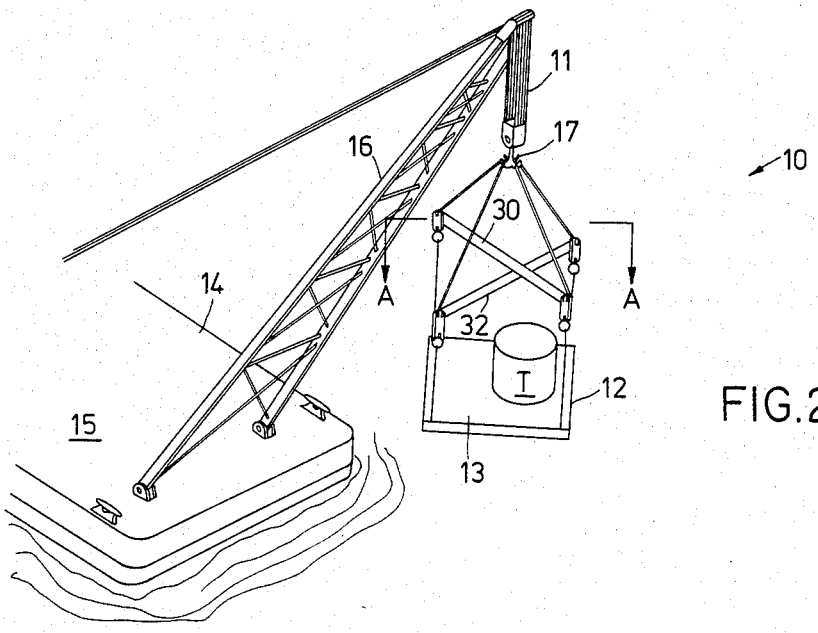
FIG. 2 is a perspective view of the composite lifting apparatus of the present invention shown in use with a floating derrick barge.
Figure 3:
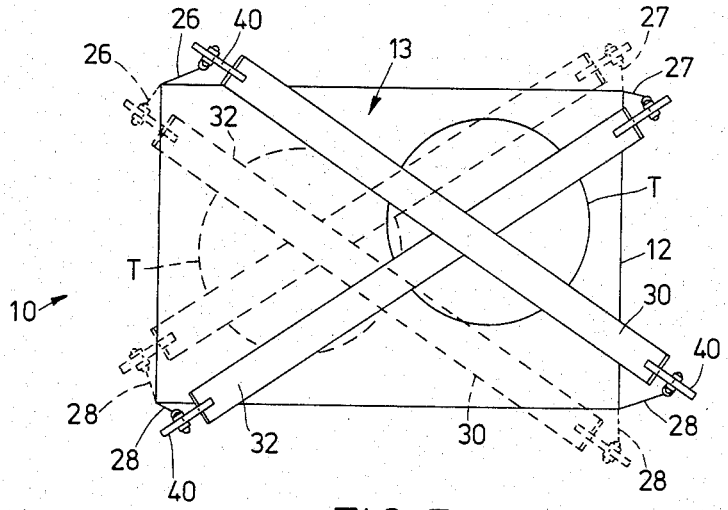
FIG. 3 is a top partial view of the composite lifting apparatus of the present invention.
Figure 4:
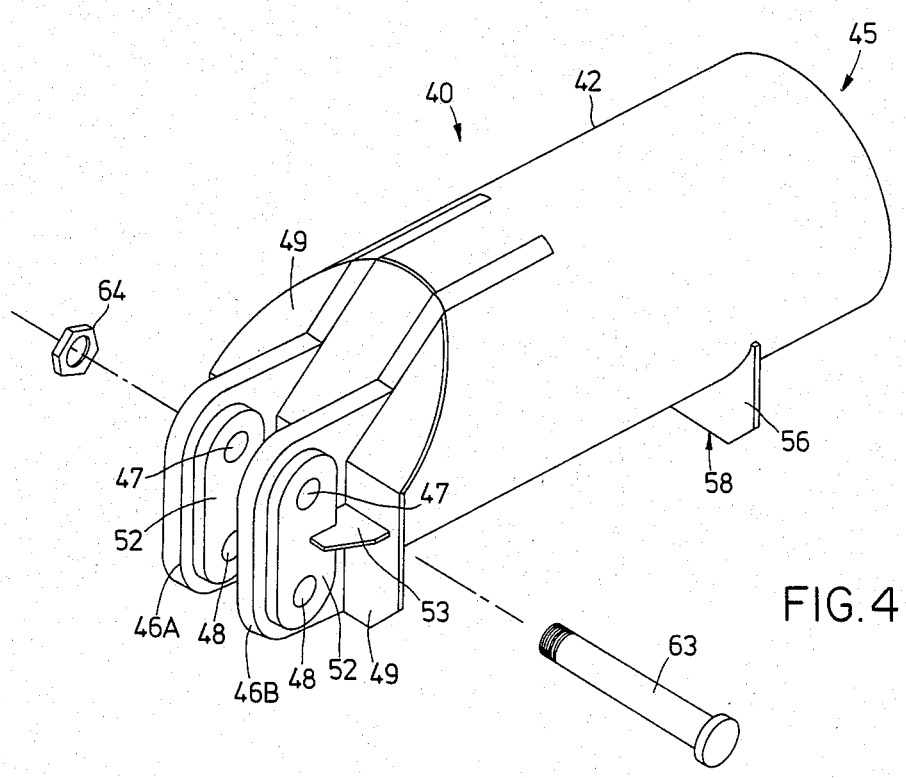
FIG. 4 is one embodiment of an end piece portion of the preferred embodiment of the apparatus of the present invention.
Figure 5:
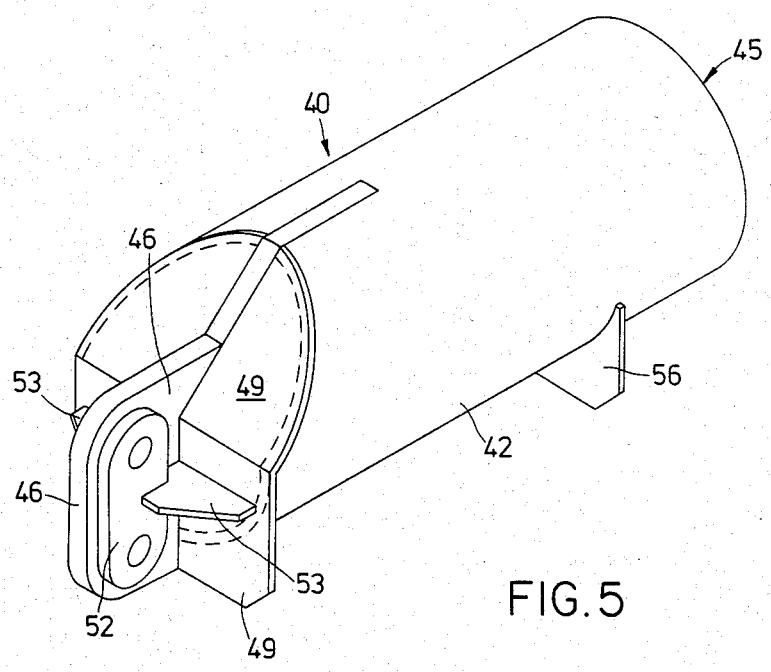
FIG. 5 is another perspective view of an end piece portion of the preferred embodiment of the apparatus of the present invention.

FIGS. 1–3 best show the preferred embodiment of the apparatus of the present invention designated generally by the numeral 10. Composite lifting assembly 10 provides a reusable, adjustable lifting assembly for supporting a load package 12 to be lifted. As described and specified herein, composite lifting assembly 10 can replace complex, expensive and often non-reusable lifting frames of fixed dimensions which are normally used to lift large packages such as oil rigs, crew quarters and the like. A primary load line 11 is supported by a structure such as derrick barge 14 shown in FIG. 2. Barge 14 provides a floating barge portion 15 which supports an elongated boom 16. A load carrying hook 17 is affixed to the lowermost portion of load line 11. FIG. 1 shows hook 17 as supporting four radially and downwardly branching load lines 20–23. Each load line provides loops 24 at the end portions. Such load lines 20–23 are commonly referred to in the industry as "slings." The loops allow one end of the load lines 20–23 to be attached to the hook 17 and the other end of the load lines 20–23 to be attached to a shackle 50 or directly to an end piece 40 which forms a part of the two spreader bars 30–32 shown in FIG. 1.

Each spreader bar 30–32 provides a pair of end pieces 40. Two embodiments of end pieces 40 are more clearly shown in FIGS. 4–11. A further discussion of end pieces and spreader bars can be seen in our prior co-pending U.S. patent application, U.S. Ser. No. 300,059 now U.S. Pat. No. 4,397,493 which is hereby incorporated by reference. Each end piece 40 attaches by means of shackles 50 to upper supporting load lines 20–23 and to lower depending load lines 25–28. Lowermost load lines 25–28 are preferably vertical so that a horizontal load component is not transmitted through pad eyes P to package 12 being lifted. Load lines 25–28 attach to package 12 at pad eyes P using shackles 50, for example.

FIGS. 2 and 3 illustrate composite lifting assembly 10 as supported by a derrick barge (FIG. 2) and a sectional view AA which is shown in FIG. 3. The package 12 in FIG. 2 shows a platform deck 13 upon which rests a heavy object such as a tank T.

For purposes of illustration, the phantom lines in FIG. 3 show the tank as having been repositioned upon deck 13. If, for example, tank T were very heavy, moving tank T from the position shown in FIG. 3 in hard lines to the position shown in FIG. 3 in phantom lines will produce a shift in the center of gravity of package 12. One of the features of the present invention is that the shift in center of gravity is automatically compensated by the lifting assembly 10. Notice that the two spreader bars 30, 32 are totally independently movable with respect to each other and they merely shift position to compensate for the shift in position of the tank T and the shift in position of the center of gravity of package 12. In FIG. 3 the new position of the spreader bars 30, 32 is shown in phantom lines corresponding with the shift in position of tank T and of the shift in position of the center of gravity of package 12. Note similarly that the depending load lines 25–28 also shift position automatically.

The length of spreader bars 30–32 as well as the length of depending load lines 25–28 would be dimensioned to accommodate the particular package 12 being lifted. Thus spreader bar 30 would have a length which would position each end piece 40 vertically above a pad eye P on the corner of package 12 so that depending load lines 25–38 would be substantially vertical and thus transmit little or no horizontal load component to pad eyes P and to the package 12 being lifted. It is desirable to minimize horizontal load component transmitted to the package so that reinforcement of the package (which otherwise might be required during lifting of the package) is correspondingly minimized. It is also desirable to have substantially vertical load lines 25–28 so that the load lines "clear" the peripheral area of the package being lifted including outer walls, protruding piping, vessels, equipment skids and the like.

Thus, the shift in tank T and the shift in positions of spreader bars 30 and depending load lines 25–38 is exaggerted in FIG. 3 for purposes of illustration.

It should be appreciated that using the above composite lifting assembly allows very large loads to be lifted such as, for example, in excess of one thousand (1000) tons. It should also be appreciated that the composite lifting assembly of the present invention allows the lifting of packages which are very bulky in addition to their weight. Thus, the present invention allows lifting of packages having relatively high dimensions. For example, the present invention has been used for the lifting of bulky packages such as pre-fabricated offshore oil rig platforms and crew quarters on the order of fifty (50) to one hundred (100) feet in length and width, and heights on the order of forty (40) to sixty (60) feet.

Figure 6:
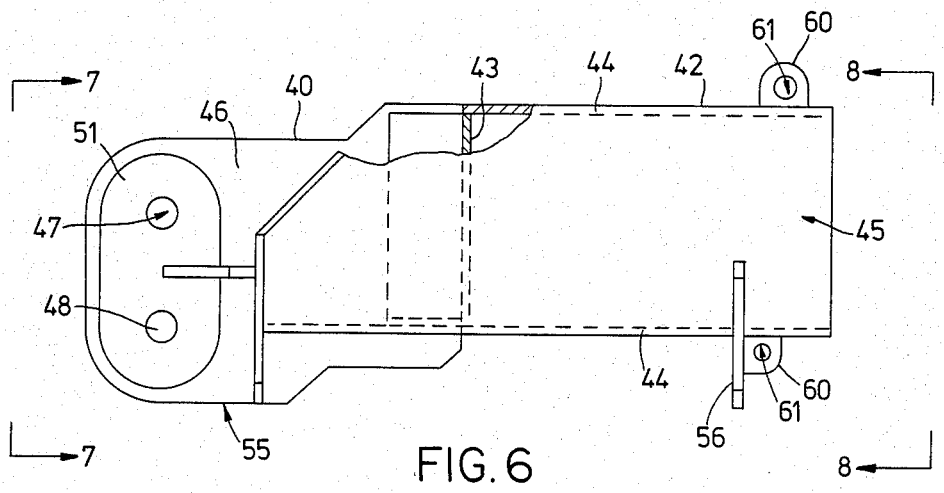
FIG. 6 is a partially broken side view of the end piece of FIG. 4.
Figure 7:
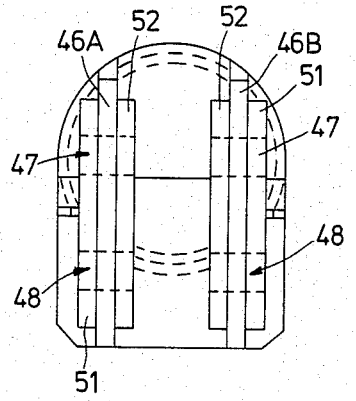
FIG.7 is an end view taken along lines 7—7 of FIG. 6.
Figure 8:
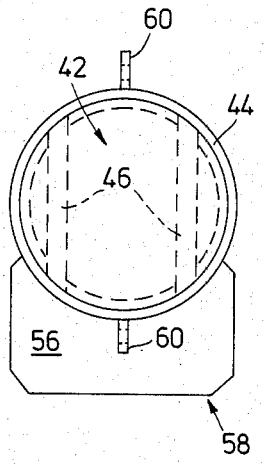
FIG. 8 is an end view taken along lines 8—8 of FIG. 6.

FIGS. 6–8 illustrate one embodiment of end piece 40. The embodiment of end piece 40 allows load lines 20–23 and 25–28 to attach to end piece 40 without the need for shackles 50.

Figure 9:
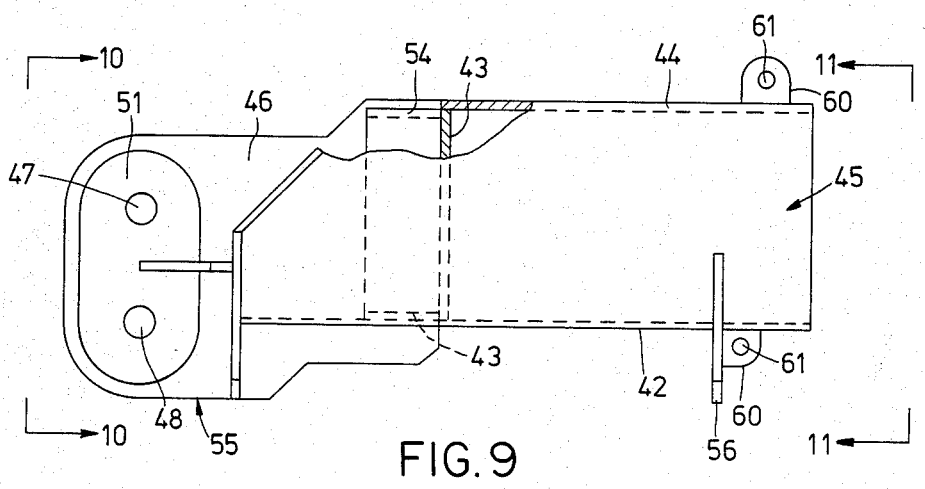
FIG. 9 is a partially broken side view of the end piece of FIG. 5.
Figure 10:
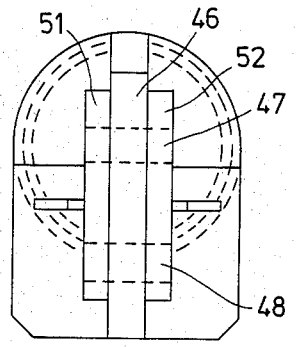
FIG. 10 is an end view taken along lines 10—10 FIG. 9.
Figure 11:
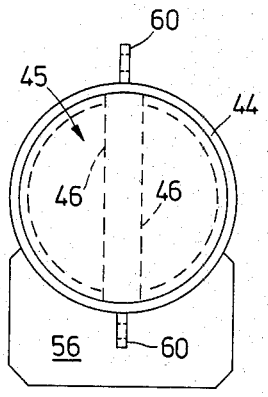
FIG.11 is an end view taken along lines 11—11 of FIG. 9.

End piece 40 can preferably slip easily upon an end portion of an elongated section of pipe, for example, so that two end pieces 40 in combination with an elongated section of pipe or other similar elongated structural element form spreader bars 30, 32. The compression applied to each end piece 40 forces it inwardly with respect to the center of spreader bar 30, 32 retaining it in position and operation. In FIG. 6, a side partially sectional view of end piece 40 is shown providing a cylindrical socket 42 which would preferably have an internal diameter substantially equal to or slightly larger than the spreader bar 30, 32 to which it is affixed and would be of a corresponding cross section with cylindrical cross sections being preferred. Spreader bars 30, 32 would slip into socket 42 with minimum tolerance for clearance, providing a good structural connection during the lifting operation between spreader bars 30, 32 and end pieces 40. Transversely mounted stop plate 43 limits the degree of penetration of each spreader bar 30, 33 into socket 42 once bar 30 is placed into the open end portion 45 of socket 42 to complete the total spreader bar assembly. Behind the transverse stop plate 43 and extending therefrom in a direction away from the open end 45 of socket 42 is a longitudinal plate 46 having a pair of vertically spaced openings 47–48 therein. The rear of end piece 40 is closed by intersection plates 49 which form an integral connection with both socket 42 and longitudinal plate 46. Gussets 53 can further strengthen end piece 40. A cylindrical reinforcing sleeve 54 is placed within socket 42 and behind stop plate 43. A pair of plates 46A, 46B are shown in FIGS. 6, 7 and 8 which are spaced apart and generally parallel while the embodiment of FIGS. 9–11 shows a single plate. By using a pair of spaced apart plates 46 as shown best in FIG. 7, shackles are eliminated since a pin placed through openings 47 of the two plates 46A, 46B would replace the pin of a shackle. Note that each plate 46 is reinforced on both sides by link plates 51, 52. Each link plate 51, 52 provides corresponding openings 47, 48 which correspond to and align with the openings 47 of plate 46. Thus overall combined openings are provided through which pins can be attached. Pins 63 would be elongated, tubular elements having external diameters substantially equal to or slightly smaller than the internal diameter of openings 47, 48. Pins 63 would also have a dimension which corresponds with the space between the outer surfaces of plates 51 and pass completely through both openings 47 and 48. The ends of these pins could be threaded, for example, and provided with bolts 64 so that they could be assembled in place.

Plates 51, 52 are continuous plates spanning between openings 47, 48. In practice, plates 51, 52 could be designed to carry the entire load between a particular upper load line 20–23 and a particular lower depending load line 25–28. Thus, the plurality of plates 46A and 51, 52 or 46B and 51, 52 provide a triple factor of safety.

The lowermost surface 55 of plate 46 is generally flat and longitudinal and provides in combination with foot 56 a stand for holding end piece 40 in an upright position. This position is best seen in FIGS. 6–8 and allows easy assembly of the complete spreader bars 30–32 by placing the end of a section of pipe into the open end 45 of end piece 40. Plate 56 also provides a lowermost flattened surface or edge which registers with a common horizontal plane occupied by edge 55 during operation such as when end piece 40 is placed upon a flat surface such as the ground.

Eyelets 60 providing central openings 61 are provided on the top portion and lowermost portion of end piece 40 and adjacent open end 45 thereof. Eyelets 60 allow an initial connection between two end pieces 40 when they are assembled upon a particular spreader bar 30, 32 as shown in FIG. 1 of the drawings. The eyelets allow two end pieces to be held together prior to lift time so that one of the end pieces will not slip off inadvertently.

The present invention could be manufactured of any suitable structural material such as structural steel and could be manufactured by fabrication, welding, and other such techniques for assembling structural steel.

Because many varying and different embodiments may be made within the scope of the inventive concept herein taught, and because many modifications may be made in the embodiments herein detailed in accordance with the descriptive requirements of the law, it is to be understood that the details are to be interpreted as illustrative and not in a limited sense.

What is claimed as our invention is:

1. A composite spreader bar lift system comprising:

a. a primary common load line;

b. a bridle assembly depending from the primary load line and comprising four radially spaced, downwardly branching bridle lines;

c. a pair of separate elongated support bars, each supported independently of the other support bar by the bridle lines in alternate radial positions so that: (1) each support bar can move independently of the other during a lift responsive to a change in position of the package being lifted, and (2) the ends of the support bars can be maintained in corresponding radially spaced apart positions with respect to the load line;

d. four secondary load lines, each attached at its upper end respectively to an end of one of the support bars so that each secondary load line can hang in a vertical position when all of the secondary load lines are spaced apart such as during a lift; and e. each secondary line at the lower end thereof being connectable to a weighted package that is to be lifted.

2. The apparatus of claim 1, wherein two of the branching bridle lines are of substantially equal length and shorter than the other of the branching lines.

3. The apparatus of claim 1, wherein one of the elongated bars is placed during operation above and at angles to the other of the bars.

4. The apparatus of claim 1, wherein each of the branching lines is paired with another thereof, the pairs being of substantially equal length.

5. The apparatus of claim 1, wherein the four depending secondary load lines are generally vertical during lifting so that the horizontal load component transmitted by each load line is minimized.

6. The apparatus of claim 1, further comprising a plurality of lifting eye means removably connected to the support bars for forming a connection between the bridle assembly and the secondary load lines.

7. The apparatus of claim 6, wherein each of the lifting eye means includes a pair of spaced openings respectively receptive of the bridle lines and secondary load lines.

8. The apparatus of claim 6, wherein each of the lifting eye means carries a pair of spaced apart pins removably connectable to the bridle lines and secondary load lines respectively.

* * * * *